US005256938A

United States Patent [19]

Xie et al.

[11] Patent Number: 5,256,938

[45] Date of Patent: Oct. 26, 1993

[54] ECR ION SOURCE WITH ELECTRON GUN

[75] Inventors: Zu Q. Xie, El Cerrito; Claude M. Lyneis, Berkeley, both of Calif.

[73] Assignee: The United States of America as represented by the Department of Energy, Washington, D.C.

[21] Appl. No.: 843,335

[22] Filed: Feb. 28, 1992

[51] Int. Cl.[5] ..... H01J 17/26

[52] U.S. Cl. ..... 315/111.81; 313/231.31

[58] Field of Search ..... 315/111.21–111.91, 315/94, 149; 118/715, 723, 724, 50.1; 204/192.11, 298.01, 298.41; 376/139, 144; 313/231.31, 270, 337, 341

[56] References Cited

U.S. PATENT DOCUMENTS

| | | | |
|---|---|---|---|
| 3,459,988 | 8/1969 | Russell | 315/5.42 |
| 3,795,837 | 3/1974 | Chang | 315/94 |
| 4,616,157 | 10/1986 | Naylor et al. | 315/111.01 |
| 4,683,838 | 8/1987 | Kimura et al. | 118/715 |
| 4,780,642 | 10/1988 | Jacquot | 313/359.1 |
| 4,789,839 | 12/1988 | Morris | 328/234 |
| 4,911,814 | 3/1990 | Matsuoka et al. | 315/111.81 |
| 4,937,531 | 6/1990 | Odera | 328/234 |

OTHER PUBLICATIONS

IEEE Dictionary of Electrical & Electronics Terms 3rd ed pp. 305 1984.

Operating Experience with the L.B.L. ECR Source by C. M. Lyneis dated before the invention thereof by applicant.

*Primary Examiner*—Steven Mottola
*Assistant Examiner*—Michael Shingleton
*Attorney, Agent, or Firm*—Miguel A. Valdes; Roger S. Gaither; William R. Moser

[57] ABSTRACT

An Advanced Electron Cyclotron Resonance ion source (10) having an electron gun (52) for introducing electrons into the plasma chamber (18) of the ion source (10). The ion source (10) has a injection enclosure (12) and a plasma chamber tank (14). The plasma chamber (18) is defined by a plurality of longitudinal magnets (16). The electron gun (52) injects electrons axially into the plasma chamber (18) such that ionization within the plasma chamber (18) occurs in the presence of the additional electrons produced by the electron gun (52). The electron gun (52) has a cathode (116) for emitting electrons therefrom which is heated by current supplied from an AC power supply (96) while bias potential is provided by a bias power supply (118). A concentric inner conductor (60) and Outer conductor (62) carry heating current to a carbon chuck (104) and carbon pusher (114) Which hold the cathode (116) in place and also heat the cathode (16). In the Advanced Electron Cyclotron Resonance ion source (10), the electron gun (52) replaces the conventional first stage used in prior art electron cyclotron resonance ion generators.

4 Claims, 4 Drawing Sheets

ECR ION SOURCE WITH ELECTRON GUN

BACKGROUND OF THE INVENTION

The invention described herein arose in the course of, or under, contract No. DE-AC03-76SF00098 between the United States Department of Energy and Lawrence Berkeley Laboratory.

The present invention relates generally to electron cyclotron resonance ion sources, and more particularly to an improved ion source using an electron gun. The predominant current usage of the advanced ECR electron gun ion source is as a heavy ion source for experimentation in the field of particle physics.

The electron cyclotron resonance ("ECR") ion source is a well known type of ion source. In an ECR, ions are obtained through ionization of a gaseous medium by electrons which are accelerated by electron cyclotron resonance. Electron cyclotron resonance results from the interaction of a static magnetic field and an injected high frequency electromagnetic field. Since the inception of the idea, many improvements have been tried, with varying degrees of success. A variation using coaxial injection of electromagnetic waves is taught by U.S. Pat. No. 4,780,642, issued to Jacquot. A goal of the Jacquot invention, and of many of the improvements to the ECR ion sources, has been to increase the quantity of ions which are emitted therefrom.

During the operation of the cyclotron at Lawrence Berkeley Laboratory it has been discovered, somewhat inadvertently, that use of gaseous materials which include certain silicon based compounds in the ECR may, at least temporarily, provide improved performance. It was noticed that, after prolonged periods of running the ECR using gaseous silicon compounds to produce silicon ion beams, significant changes in the source tuning characteristics and performance occurred. Improvements included improved short and long term stability, reduced reflected power, and the ability to operate at lower pressure and higher power. It was theorized that the improvement in source performance was the result of deposits of silicon dioxide on the walls of the ECR chamber, and this thesis was supported by further observations. It was further theorized that the mechanism causing the improved performance was that the silicon dioxide deposit enhances the production of cold electrons at the plasma chamber walls due to its high secondary electron emission, and that those secondary electrons serve as an additional source of cold electrons to replace those heated by ECR heating. In a conventional ECR source, the primary sources of cold electrons are stepwise ionization of atoms and ions, and plasma injected from a microwave-driven first stage.

Experiments with the Lawrence Berkeley Laboratory ECR showed that, with a sufficient silicon dioxide coating in the plasma chamber of the ECR, the best performance could be obtained with the first stage off. This indicated that the secondary electrons produced on the plasma chamber walls can replace the cold electrons normally supplied by the first stage. This observed phenomenon has been called the "silicon effect", and has been reported in a paper, *Operating Experience with the LBL ECR Source; by C. M. Lyneis, one of the present inventors.*

The silicon effect provided an interesting insight into the possibility that providing a source of cold electrons might improve performance of the ECR. However, that insight, in itself, was of little practical value, since the effect lasted for only a limited period of time after deposit of the silicon dioxide on the walls of the ECR. Furthermore, since the cyclotron is in near constant use, it is impossible to schedule usage for silicon ion production just for the purpose of creating the silicon dioxide deposits. Moreover, the mechanism by which the silicon effect produces its desirable results has not been proven, at least prior to the development of the present invention, and it was, therefore, not clear what use could be made of the knowledge gained by the observation of the effect.

No prior art ECR ion source, to the inventors' knowledge, has successfully provided the advantages of the silicon effect without actually having silicon dioxide deposited within the ECR ion source, and all instances of utilization with such silicon dioxide deposits have been transitory in nature and lacking in the reliability and consistency required for continuous usage.

SUMMARY OF THE INVENTION

Accordingly, it is an object of the present invention to provide the improved operational characteristics associated with the silicon effect.

It is another object of the present invention to provide an ECR ion source which can operate continuously with improved operational characteristics, without having to be intermittently recoated with silicon dioxide, or any substitute coating material.

It is still another object of the present invention to provide an ion source which provides a high ion output rate.

It is yet another object of the present invention to provide an ion source which operates with improved stability.

It is still another object of the present invention to provide an ion source which will operate at improved neutral pressure levels.

It is yet another object of the present invention to provide an ion source which will operate at improved power levels.

It is still another object of the present invention to provide an ion source which is relatively simple and inexpensive to produce and reliable in operation.

Briefly, the preferred embodiment of the present invention is an Advanced Electron Cyclotron Resonance ("AECR") ion source, similar in structure to conventional two stage electron cyclotron resonance ion sources. The AECR ion source differs from convention electron cyclotron resonance ion sources in the AECR ion source has an electron gun affixed thereto such that electrons are emitted therefrom axially into the plasma chamber of the AECR ion source.

An advantage of the present invention is that the improved operational characteristics which have been associated with the silicon effect are provided.

A further advantage of the present invention is that it may be operated continuously without degradation of improved characteristics, and without stopping to recoat surfaces with silicon dioxide, or the like.

Yet another advantage of the present invention is that it the production of high charge state ions is increased.

Still another advantage of the present invention is that stability is increased over both the short and long term.

Yet another advantage of the present invention is that it can operate reliably at lower neutral pressures as compared to prior art devices.

Still another advantage of the present invention is that it can operate reliably at higher power levels, as compared to prior art devices.

Yet another advantage of the present invention is that it is simple and inexpensive, as compared to comparable prior art ion sources.

These and other objects and advantages of the present invention will become clear to those skilled in the art in view of the description of the best presently known mode of carrying out the invention and the industrial applicability of the preferred embodiment, as described herein and as illustrated in the several figures of the drawing.

DETAILED DESCRIPTION OF THE INVENTION

The best presently known mode for carrying out the invention is an Advanced Electron Cyclotron ion source having an electron gun for the introduction of electrons thereinto. The predominant expected usage of the inventive AECR ion source is in scientific inquiry in the field of particle physics, particularly in conjunction with experimentation using cyclotrons wherein a reliable source of heavy ions is desirable.

Figure 1:
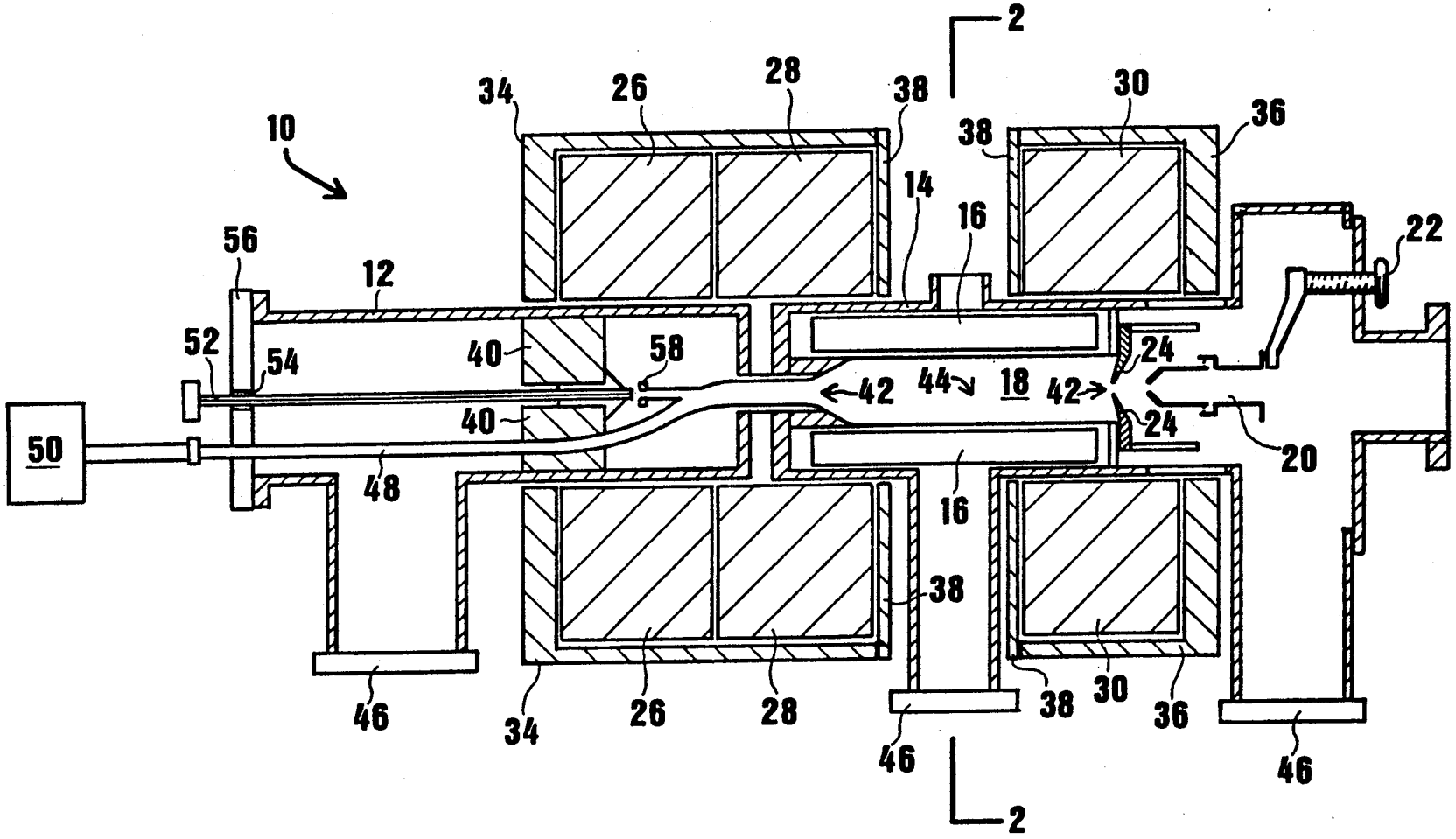
FIG. 1 is a side elevational view of an advanced electron cyclotron resonance ion source, according to the present invention.
Figure 2:
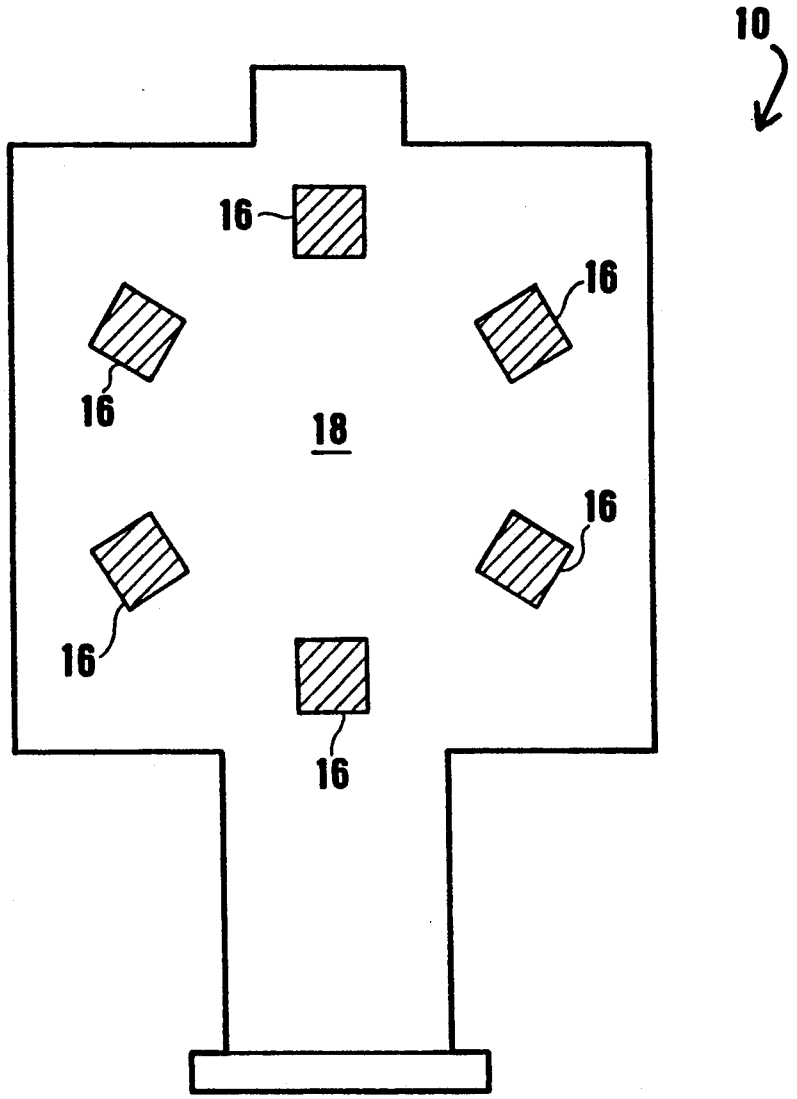
FIG. 2 is a cross sectional elevational view of the advanced electron cyclotron resonance ion source of the present invention, taken along line 2—2 of FIG. 1.

The AECR ion source of the presently preferred embodiment of the present invention is illustrated in a side elevational view in FIG. 1 and is designated therein by the general reference character 10. In many of its substantial components, the AECR ion source 10 does not differ significantly from conventional ECR ion sources. The physical structure of the AECR ion source 10 is similar to that illustrated and described in *Operating Experience with the LBL ECR Source* by C. M. Lyneis. Also, the AECR ion source 40 is similar, in many respects, to the ECR illustrated and described in U.S. Pat. No. 4,780,642, issued to Jacquot. Conventional elements of the AECR ion source 10 include an injection enclosure 12 and a plasma chamber tank 14. Within the plasma chamber tank 14, six longitudinal magnets 16 (two of which are visible in the elevational view of FIG. 1) surround a plasma chamber 18. In the best presently known embodiment 10 of the present invention, the longitudinal magnets 16 are Neodymium - Iron - Boron magnets. Referring now to FIG. 2, which is a cross sectional elevational view of the AECR ion source 10 taken along line 2—2 of FIG. it can be seen that the longitudinal magnets 16 are arranged in a circle so as to define the plasma chamber 18.

Returning again to the view of FIG. 1, other conventional elements of the AECR ion source 10 include a puller 20, the position of which is adjustable by means of a conventional puller adjustment mechanism 22, and a copper extraction electrode 24. A first magnet coil 26, a second magnet coil 28 and a third magnet coil 30 are not unlike magnet coils of the conventional ECR. In the AECR ion source ID, each of the magnet coils 26, 28 and 40 is a conventional vacuum epoxy impregnated electromagnet assembly. In the best presently known embodiment 10 of the present invention, a first iron yoke 34 surrounds the first magnet coil 16 and the second magnet coil 28, and a second iron yoke 36 surrounds the third magnet coil 30. The iron yokes 34 and 36 increase magnetic axial field at the opposed ends 42 of the plasma chamber 18, while a pair of iron plates 38, located between the second magnet coil 28 and the third magnet coil 30, reduce the axial field (that portion of the field aligned parallel to the longitudinal magnets 16) in the center 44 of the plasma chamber 18 to achieve the required mirror ratio for the plasma chamber 18. Also, in the best presently known embodiment 10 of the present invention, an iron plug 40 has increased the injection peak field to more than one tesla. A plurality (three, in the best presently known embodiment 10 of the present invention) of pump ports 46 are connected to conventional turbomolecular pumps (not shown) for evacuating the AECR ion source 10, as is commonly done with conventional ECR ion sources. High frequency electromagnetic energy is introduced into the plasma chamber 18 through a wave guide 48 from a 14 GHz, 2.5 kW klystron 50. This type of klystron 50 was chosen because commercial klystron amplifier systems (not shown) are available at this frequency. All of the above elements of the best presently known embodiment 10 of the present invention, while varying somewhat in detail from corresponding conventional ECR elements, as befits their adaption to the AECR ion source, do not vary substantially from conventional and well known equivalents found in conventional ECR ion sources.

In accordance with the present invention, an electron gun 52 is provided for introducing electrons into the plasma chamber 18 of the AECR ion source 10. The electron gun 52 is positioned through an aperture 54 in an injection conflat flange 56 of the AECR ion source 10. In the best presently known embodiment ID of the present invention, the electron gun 52 is positioned such that electrons are emitted therefrom generally axially into the plasma chamber 18 through an electron entrance port 54.

Figure 3:
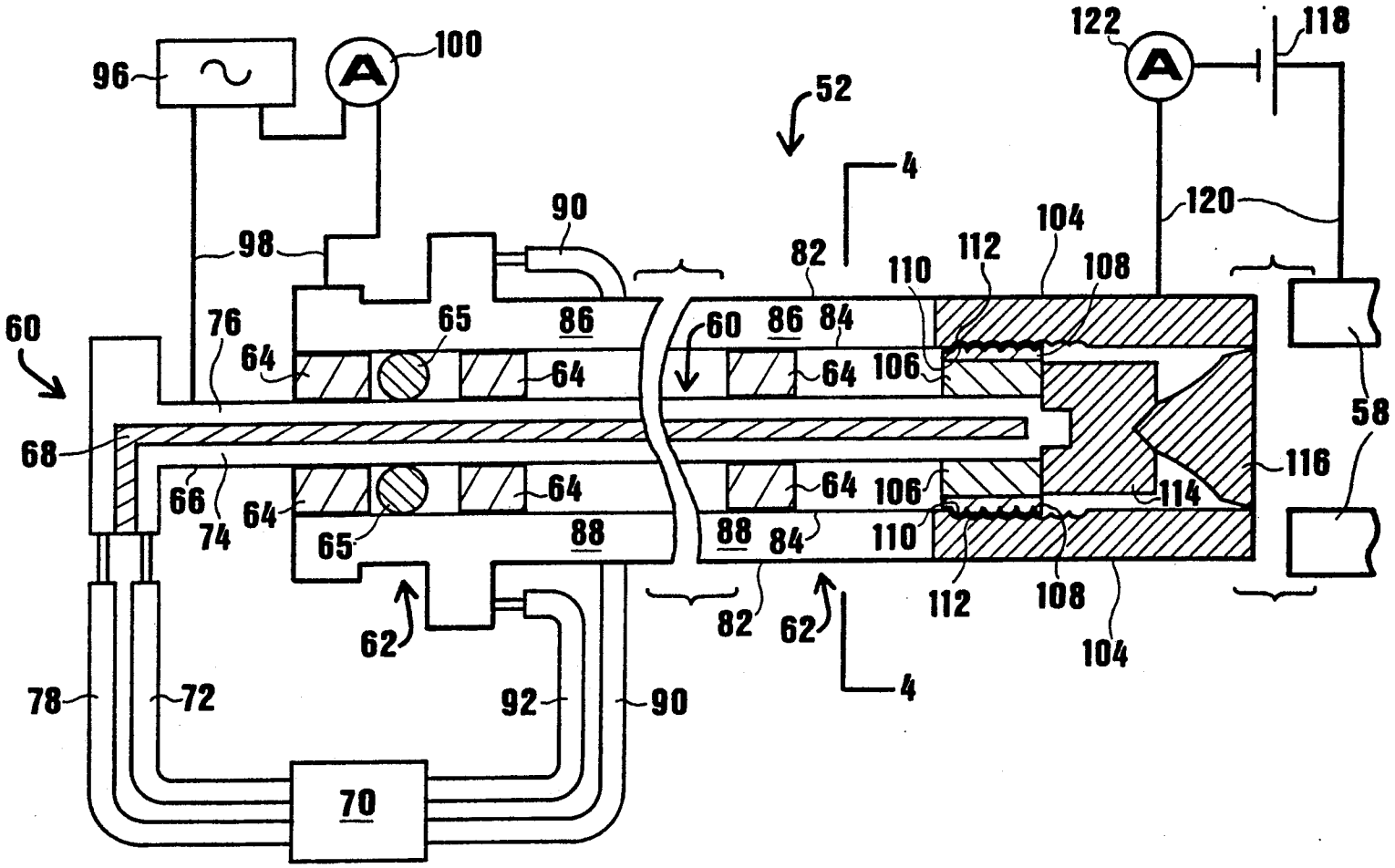
FIG. 3 is a broken elevational view of an electron gun, according to the present invention.
Figure 4:
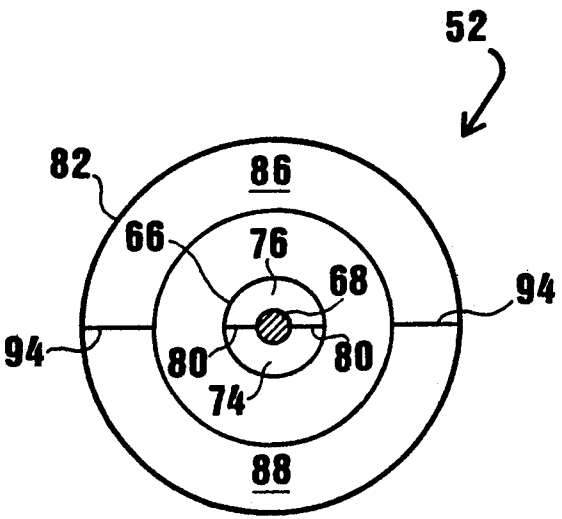
FIG. 4 is a cross sectional view of the electron gun of the present invention, taken along line 4—4 of FIG. 3.

Now referring to FIG. 3, which is a broken elevational view of the electron gun 58, the electron gun 52 has an inner conductor 60 and a concentric outer conductor 62. The inner conductor 60 is separated from the outer conductor 62 by means of a plurality of insulators 64, of which three are visible in the view of FIG. 3. An vacuum seal 65 is provided to prevent loss of vacuum within the AECR ion source 10 between the inner conductor 10 and the outer conductor 62. The inner conductor 60 has an inner conductor shell 66 and an inner conductor central core 68. Cooling water is pumped from a water pump 70 through an inner conductor water inlet tube 72 to an inner conductor water inlet passage 74 between the inner conductor shell 66 and the inner conductor core 68. The coolant then flows from the inner conductor water inlet passage 74 to an inner conductor water outlet passage 76, from which it is returned to the water pump 70 through an inner conductor water outlet tube 78. Now referring to FIG. 4, which is a cross sectional view of the electron gun 52 taken along line 4—4 of FIG. 3, it can be seen that a pair of inner conductor coolant baffles sc separate the inner conductor water inlet passage 74 from the inner conductor water outlet passage 76 along a substantial portion of the length of the inner conductor 60.

Now referring again to FIG. 3, the outer conductor 62 has an outer conductor outer shell 82 and a concentric outer conductor inner shell 84. Between the outer conductor outer shell 82 and the outer conductor inner shell 84 are an outer conductor water inlet passage 86 and an outer conductor water outlet passage 88. Coolant is pumped from the water pump 70 through an outer conductor water inlet tube 90, into the outer conductor water inlet passage 86, then into the outer conductor water outlet passage 88, from which it is returned to the water pump 70 through an outer conductor water outlet tube 92.

Now referring again to FIG. 4, it can be seen that a pair of outer conductor coolant baffles 94 separate the outer conductor water inlet passage 86 from the outer conductor water outlet passage 88 along a substantial portion of the length of the outer conductor 62. As can be appreciated, the inner conductor coolant baffles so do not extend quite the entire length of the inner conductor 60, nor do the outer conductor coolant baffles 94 extend quite the entire length of the outer conductor 62, else cooling water could not progress from the inner conductor water inlet passage 76 to the inner conductor water outlet passage 78, or from the outer conductor water inlet passage 86 to the outer conductor water outlet passage 88.

In the best presently known embodiment 10 of the present invention, an AC power supply is connected to the inner conductor 60 and the outer conductor 62 through a pair of heater current wires 98. A heater current meter 100 is inserted in one of the heater current wires 98 to provide a means for monitoring heater current.

The outer conductor 62 is terminated at the distal end 102 of the electron gun 52 in a carbon chuck 104, and the inner conductor 60 is encircled at the distal end 102 of the electron gun 52 by a boron nitride sleeve 106. The boron nitride sleeve 106 is slidably inserted within a conductive jacket 108, and the conductive jacket 108 has an outer notched surface 110 for mating with an inner notched surface 112 of the carbon chuck 104. By the action of sliding the boron nitride sleeve 106 through the conductive jacket 108 the inner conductor 60 may be advanced slightly toward the distal end 102 of the electron gun 52. When the inner conductor 60 is so advanced, a carbon pusher 114 causes a cathode 116 to be pushed toward the distal end 102 of the electron gun 52. This adjustment is made desirable by the fact that the cathode 116 is slightly expended in the process of emitting electrons therefrom, and it may be necessary to push it toward the distal end 102 of the electron gun in order to keep it in optimal position.

As can be seen in the view of FIG. 3, an electrical path is provided from the inner conductor 60 through the Carbon pusher 114, the cathode 116, the carbon chuck 104 and the conductive jacket 108, such that current from the AC power supply 96 is passed through those components. Heating occurs as the current is passed through these components, which provides the heating necessary for providing the condition for emitting electrons from the cathode 116. In the best presently known embodiment 10 of the present invention, heating current is from 280 to 350 Amps at 2 to 3 volts, which produces cathode temperatures of from 1250° C. to 1350° C.

In the best presently known embodiment 10 of the present invention, the cathode 116 is made from lanthanum hexaboride, because of the superior electron emission characteristics, longer life, and lower evaporation as compared to tungsten materials. A bias power supply 118 provides bias voltage to the cathode 116, in relation to the electron entrance port 58, through a pair of bias supply conductors 120, and the carbon chuck 104, the conductive jacket 108, the boron nitride sleeve 106, and the carbon pusher 114. A bias supply meter 122 is inserted into One of the bias supply conductors 120 for monitoring bias current to the cathode 116.

Figure 5:
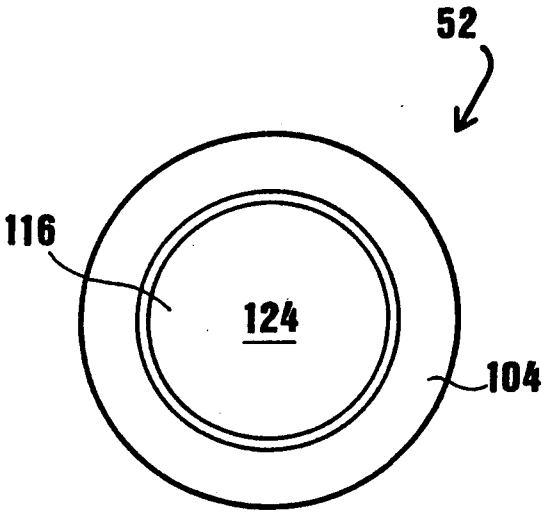
FIG. 5 is an end view of the electron gun of the present invention showing the electron emitting surface of the cathode of the electron gun.

Referring now to FIG. 5, which is an end elevational view of the electron gun 52, as viewed from the distal end 102, it can be seen that an electron emission surface 124 of the cathode 116 is exposed within the carbon chuck 104. In the best presently known embodiment 10 of the present invention, the electron emission surface 124 is 0.58 $cm^2$ in area.

In the AECR ion source 10, electrons are injected on axis. This may increase the electron density on axis and improve ion radial confinement. It could also effect the extraction of ions, since the injected electrons have relatively large longitudinal velocities and are, therefore, not magnetically confined in the mirror field. Experimentation with the AECR ion source seems to support this idea. However, the scope of the present invention is not intended to be limited to the injection of electrons on axis, as further experimentation may well lead to improved placement of the electron gun 52. Furthermore, it is anticipated that the electron gun 52 illustrated and described, herein, as that used in conjunction with the best presently known embodiment 10 of the present invention may be improved upon further experimentation. Therefore, the configurations of the electron gun 52, or of the more conventional elements of the AECR ion source 10 described herein, are not intended to be a limiting factor of the invention.

As is shown above, in great part, the AECR ion source 10 according to the present invention closely resembles prior art conventional electron cyclotron resonance ion sources in many respects. Among the substantial differences are the inclusion of the electron gun 52 for the injection of cold electrons into the plasma chamber 18. No significant changes of materials are envisioned nor are any special constructions required.

Various modifications may be made to the invention without altering its value or scope. For example, construction of the magnet coils 26, 28 and 30 might be varied according to known construction parameters for such devices. Similarly, values and capacities of elements such as the klystron 50 might be varied as further experimentation reveals the desirability of improving such parameters.

All of the above are only some of the examples of available embodiments of the present invention. Those skilled in the art will readily observe that numerous other modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

The Advanced Electron Cyclotron ("AECR") ion source is intended for use in any cyclotron or similar application where the emission of heavy ions is required. The AECR ion source has demonstrated improved performance, even as compared to prior art ECR sources operating with a transitory silicon dioxide coating. It is difficult to interpret the mechanism by which injection of cold electrons into the ECR plasma improves high charge state ion performance, since measurement of crucial plasma parameters, such as plasma density, plasma potential, electron temperature, and ion confinement time, have not been done. However, it appears that injecting electrons increase the plasma density in the AECR ion source since total extracted current increases by a factor of about 2.5, as does the optimum microwave power. The success of the AECR ion source is consistent with the explanation that the silicon effect is due to enhanced production of cold electrons at the plasma chamber walls.

Since the AECR ion source will operate continuously with the stability and increased performance formerly associated with the silicon effect, it is expected that efficiency of usage of the cyclotron will result, since the increased performance characteristics are not dependent upon the type of materials that have been used in preceding experiments. Further, since the AECR ion source is relatively simple in construction, and very stable in operation it is expected that down time will be minimized, as will set up time for each successive experiment.

The AECR ion source of the present invention may be utilized in any application wherein conventional heavy ion sources are used. Since the AECR ion source of the present invention may be readily constructed and is physically significantly similar to prior art conventional ECR ion sources, it is expected that it will be acceptable in the field as a substitute for the conventional ECR ion sources, as well as for other types of heavy ion sources. For these and other reasons, it is expected that the utility and industrial applicability of the invention will be both significant in scope and long-lasting in duration.

We claim:

1. In an electron cyclotron resonance ion source, the improvement comprising:

an electron gun for emitting electrons into the electron cyclotron resonance ion source, wherein;

a bias power source provides bias voltage between said electron gun and the electron cyclotron resonance ion source such that electrons are provided with potential for moving from said electron gun into the electron cyclotron resonance ion source.

2. The improved electron cyclotron resonance ion source of claim 1, wherein:

said electron gun injects electrons into an end of the electron resonance in source.

3. The improved electron cyclotron resonance ion source of claim 1, wherein:

said electron gun includes a cathode which, when heated, emits electrons therefrom into a plasma chamber of the electron cyclotron resonance ion source.

4. The improved electron cyclotron resonance ion source of claim 1, wherein:

said electron gun includes a cathode which is held in place at a distal end of said electron gun by means of a carbon chuck, such that the cathode may be moved within the electron gun as it is eroded by the process of emitting electrons therefrom to compensate for changes in the length of the cathode.

* * * * *